United States Patent [19]

Christensen et al.

[11] 4,422,703

[45] Dec. 27, 1983

[54] ELECTRICAL CONNECTOR FOR USE WITH MULTI-PIN ARRAYS

[75] Inventors: Gordon D. Christensen, San Jose; Charles J. Donaher, Los Altos Hills, both of Calif.

[73] Assignee: Thomas & Betts Corporation, Raritan, N.J.

[21] Appl. No.: 302,445

[22] Filed: Sep. 15, 1981

[51] Int. Cl.[3] ..... H01R 13/629

[52] U.S. Cl. ..... 339/74 R; 339/17 CF

[58] Field of Search ..... 339/17 CF, 75 M, 74 R, 339/176 M

[56] References Cited

U.S. PATENT DOCUMENTS

| | | | |
|---|---|---|---|
| 2,126,674 | 8/1938 | Stout | 173/328 |
| 2,857,577 | 10/1958 | Vanderpool | 339/17 |
| 3,094,365 | 6/1963 | Chamberlain et al. | 339/75 |
| 3,229,926 | 7/1967 | Aksu et al. | 339/176 |
| 3,395,377 | 7/1968 | Straus | 339/17 |
| 3,426,313 | 2/1969 | Wycheck | 339/74 |
| 3,474,387 | 10/1969 | Krum et al. | 339/75 |
| 3,478,301 | 11/1969 | Conrad et al. | 339/75 |
| 3,553,630 | 1/1971 | Scheingold et al. | 339/74 |
| 3,569,905 | 3/1971 | Kahagioglou | 339/75 |
| 3,622,941 | 11/1971 | Wetmore | 399/98 |
| 3,648,221 | 3/1972 | Tillmann et al. | 339/74 |
| 3,740,839 | 6/1973 | Otte et al. | 29/628 |
| 3,750,085 | 7/1973 | Cooper | 339/75 |
| 3,821,691 | 6/1974 | Reimer | 339/75 |
| 3,861,030 | 1/1975 | Otte et al. | 29/626 |
| 3,865,457 | 2/1975 | Carter | 339/74 |
| 3,912,353 | 10/1975 | Kasuya et al. | 339/75 |
| 3,923,361 | 12/1975 | Rosen | 339/47 |
| 3,963,317 | 6/1976 | Eigenbrode et al. | 339/74 R |
| 4,012,099 | 3/1977 | Worcester | 339/75 M |
| 4,050,758 | 9/1977 | Curley | 339/74 |
| 4,080,032 | 3/1978 | Cherian et al. | 339/75 |
| 4,159,154 | 6/1979 | Arnold | 339/74 |
| 4,159,861 | 7/1979 | Anhalt | 339/75 |
| 4,189,199 | 2/1980 | Grau | 339/75 |
| 4,196,955 | 4/1980 | Anhalt | 339/74 |
| 4,274,694 | 6/1981 | Leather | 339/74 R |
| 4,303,294 | 12/1981 | Hamsher, Jr. et al. | 339/74 R |

FOREIGN PATENT DOCUMENTS

| | | |
|---|---|---|
| 1118852 | 12/1961 | Fed. Rep. of Germany . |
| 538757 | 8/1941 | United Kingdom . |

OTHER PUBLICATIONS

Excerpt: IBM Technical Disclosure Bulletin, vol. 13, No. 6, Nov., 1970, p. 1549, Brain.

Connectors and Interconnections Handbook, Gerald L. Ginsberg, Editor, vol. 2, 1979, pp. 4–17 to 4–19 and pp. 4–20 to 4–22.

*Primary Examiner*—John McQuade

*Attorney, Agent, or Firm*—Salvatore J. Abbruzzese; Salvatore J. Abbruzzese

[57] ABSTRACT

A connector for zero or low insertion force receipt of multi-pin arrays, such as those in very large scale integration (VLSI) components, includes cam surfaces for selective movement to oppose the self-biasing forces of connector contacts for pin insertion and reverse movement to permit the contacts to effect tight engagement with the pins under the influence of such self-biasing forces.

14 Claims, 11 Drawing Figures

ELECTRICAL CONNECTOR FOR USE WITH MULTI-PIN ARRAYS

FIELD OF THE INVENTION

This invention relates generally to electrical connectors and pertains more particularly to connectors of so-called zero or low insertion force type for use with multi-pin arrays.

BACKGROUND OF THE INVENTION

The primary advantage in the use of zero insertion force connectors, namely, minimizing loading of interfitting contacts during connection, takes on particularly great significance as the number of contacts simultaneously made increases to levels today seen with circuit components produced by very large scale integration (VLSI) techniques. In this sector, a VLSI device may present a twenty-by-twenty pin array, i.e., a total of four hundred pins, for simultaneous individual mating with collectively supported sockets. The loading forces attending such connection are, of course, cumulative of the force per mating contact pair and can readily amount to a level which may be unattainable for an assembler or not sustainable by support housings of the respective pins and sockets.

A further problem presented to the connector designer by VLSI is that of readily facilitating connection and disconnection and while minimizing the space in which such insertion connection and disconnection are to be effected. Customary practices in the art in larger environs are not applicable. In the above example of VLSI connection, the twenty-by-twenty pin array may be presented in a square of less than two inches per side. In such limited space, the use of such measure as translation of separate socket contact parts into engagement with a pin following positioning of the pin in residence between the parts is unlikely, as is use of such measure as translating a contact-making slide through the plane of a contact array. One known VLSI zero-insertion force practice looks, rather than to such customary measures, to the deformation of a socket upon a pin resident therein. Use is made, for example, of a ring loosely encircling the socket when exposed to refrigerant-produced temperatures. Following assembly, the ring is responsive to return to ambient temperatures and shrinks tightly upon the socket to effect electrical connection thereof to the pin. Resort to such exotic measure both evidences the difficulty of the problem presented by VLSI to the connector art and present costliness of approaches to solve the problem.

SUMMARY OF THE INVENTION

The present invention has as its primary object the provision of a simplified connector for interconnecting multi-pin arrays to corresponding sockets.

A more particular object of the invention is to provide separable interconnection of multi-pin/socket arrays with zero or low insertion force.

A still further object of the invention is to provide a connector for interconnection of VLSI devices and companion components without need for resort to thermally-adaptive connector components.

In attaining these and other objects, the invention provides a connector having a plurality of contacts having socket terminals disposed in an array corresponding to the multi-pin array and opposite terminals for connection to companion apparatus. The socket terminals are each formed with facing elements thereof closingly biased toward one another to electrically engage a pin to be received therein. A cam is supported for movement in the connector and defines cam surfaces collectively movable from one position opposing such closing bias of the contact elements and displacing the same to facilitate low-insertion force entry of pins therein to a second position wherein the cam surfaces are inactive in such function and permit self-biased tight engagement of the contact elements with the pins.

In its preferred configuration for VLSI device usage, the cam is a plate member of x–y dimensions approximating those of the VLSI device defining the pin array, and having channels therethrough for the passage of the contacts. Such cam surfaces are arranged contiguously with the passages.

In its particularly preferred embodiment, the connector of the invention has its constituent parts selected and arranged to provide low rather than zero insertion force. Thus, the invention looks toward socket terminals which slightly frictionally engage pins while the cam is operative, i.e., opposes the natural closing self-bias of contact elements to facilitate pin entry therein. Upon movement of the cam to its inoperative position, the contact elements, under self-bias, effect a wiping action upon the pins to effect gas-tight connection therewith.

The foregoing and other features of the invention will be further evident from the following detailed discussion of the particularly preferred embodiment thereof and from the drawings wherein like reference numerals identify like parts throughout.

DESCRIPTION OF THE PREFERRED EMBODIMENT

Figure 1:
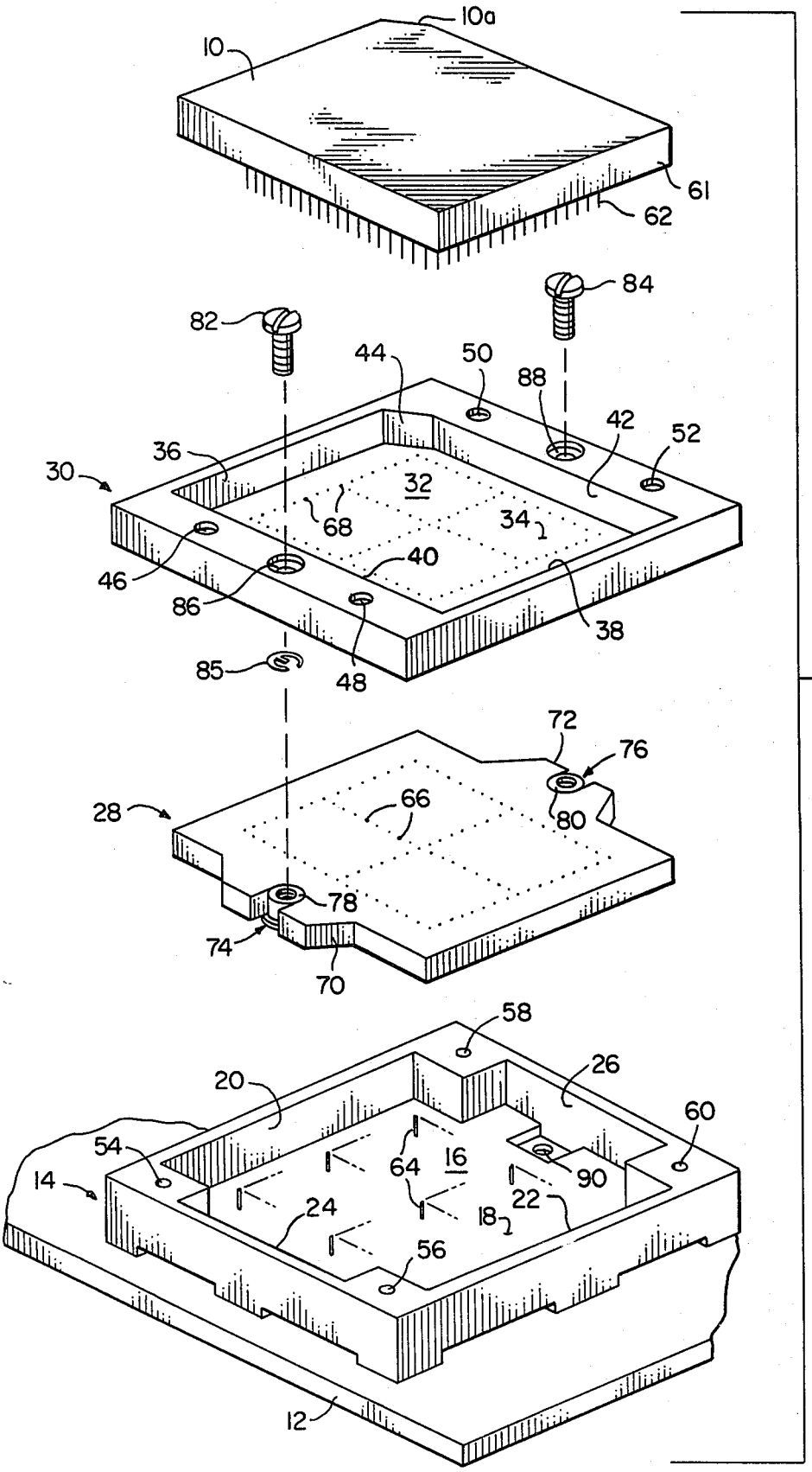
FIG. 1 is an exploded perspective view of a connector in accordance with the invention and showing both a VLSI device and a companion component to be connected thereby with the VLSI device.
Figure 5:
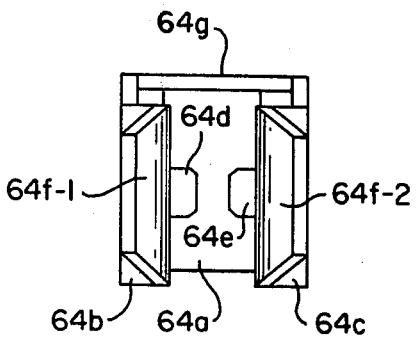
FIGS. 3–5 are respective front, side and top plan elevations of the FIG. 2 contact.
Figure 2:
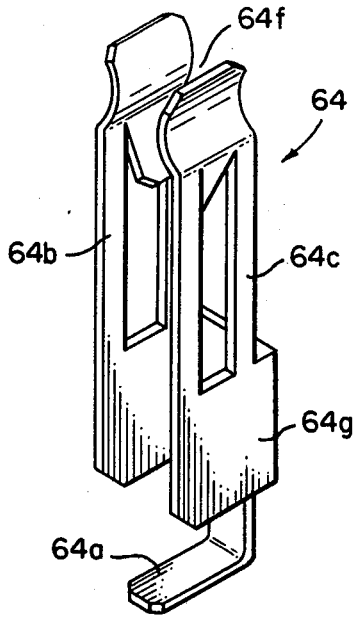
FIG. 2 is a perspective view of a contact for use in the connector of FIG. 1.

FIG. 1 depicts VLSI device 10 and companion apparatus 12 for connection thereto, for example, a printed circuit board (PCB). A connector for effecting such interconnection in accordance with the present invention comprises a housing having a base 14, defining compartment 16 upstanding from base floor 18 and bounded by sidewalls 20 and 22 and end walls 24 and 26. A cam plate 28 is shown above base 14. Cover or cap 30 of the housing has compartment 32 upstanding from cover floor 34 and bounded by sidewalls 36 and 38, end walls 40 and 42, and keying wall 44 which extends between side wall 36 and end wall 42. For assembly of connector parts, cover 30 has through-bores 46,48,50 and 52 and base 14 has suitably threaded registering bores 54,56,58 and 60. Fastener bolts (not shown) are passed through bores 46–52 and threaded into bores 54–60 for securing cover 30 to base 14, entrapping cam plate 28 within the housing.

VLSI device 10 has x–y dimensions compatible with like dimensions of compartment 32 of cover 30, with keying wall 10*a* orientated compatibly with keying wall 44 of cover 30. Pins 62 depend from undersurface 61 of VLSI device 10 in an x–y square array, of rows and columns for example, a twenty pin by twenty pin predetermined array having a total of four hundred pins. Contacts 64 are supported in base 14 in the same array as pins 62 on floor 18. As will be seen in detail in enlarged views below, cam plate 28 has apertures 66 extending therethrough and arranged in the same array as the contacts 64. Cover 30 similarly includes passages 68 in such array, whereby contacts 64 may extend through cam plate 28 and cover 30 to be accessible from the upper exterior of the housing to receive pins 62.

Cam plate 28 has end wings 70 and 72 providing detents 74 and 76 for the retentive seating of inserts 78 and 80. Such inserts each have an interiorly threaded bore for receipt of exteriorly threaded cam actuating pin members 82 and 84. Cover 30 is provided with openings 86 and 88 for passage of members 82 and 84 therethrough. Members 82 and 84 are accessible exteriorly of the housing and are secured to cover 30, as by use of snap rings (ring 85 also being shown in FIG. 9) applied thereto at the undersurface of cover 30. Upon such assembly of members 82 and 84 with cover 30 and subsequent fastening of cover 30 to base 14, as above discussed, the lower ends of members 82 and 84 seat freely in base recesses, one such recess being shown at 90.

As is described in detail below, members 82 and 84 function as position control means for cam plate 28, i.e., by turning the members, the plate may be disposed to confront base floor 18 or to confront the undersurface of cover 30.

Figure 3:
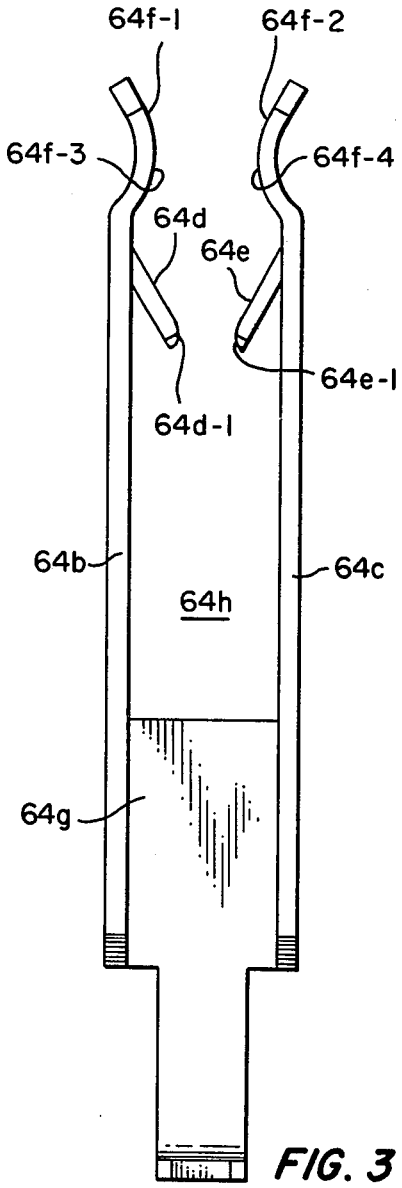
Figure 4:
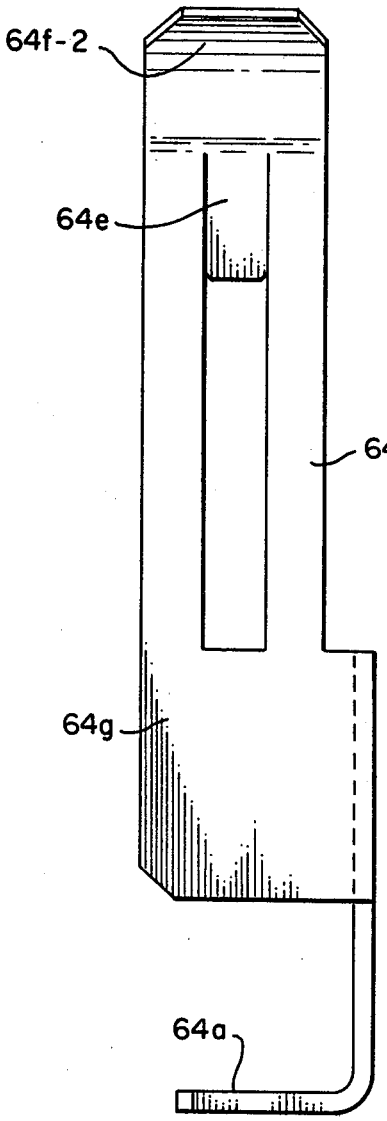

Turning now to FIGS. 2–5, contact 64 has a first terminal 64*a* which extends through base 12 to be accessible below the base for engaging a terminal of companion apparatus, e.g., terminal 64*a* may be wave soldered to a conductive strip on PCB 12 (FIG. 1). Terminal 64*a* may also be formed in straight downward configuration for insertion into suitable metallized openings provided in PCB 12 and soldered therein by conventional wave-flow soldering techniques. A second terminal, serving as a pin-receiving socket, is provided opposite such first terminal and is defined by facing elements 64*b* and 64*c* which are formed in self-biased preselected attitude to assume generally parallel stance (FIG. 3). Contact 64 is formed of beryllium copper, phosphorous bronze or like material having sufficient resilience to exhibit self-bias, whereby facing elements 64*b* and 64*c* will seek to return to such parallel relation, or other preselected self-biased attitude, after release from mutually outward forces thereon opposing such inward self-bias.

Lances 64*d* and 64*e* are struck from elements 64*b* and 64*c* to extend inwardly thereof and preferably have arcuate facing surfaces at ends 64*d*-1 and 64*e*-1. A central support section 64*g* and an outwardly flared upper pin entry section 64*f* complete the contact, parts 64*f*-1 and 64*f*-2 flowing arcuately as shown to define inturned undersurfaces 64*f*-3 and 64*f*-4 inboard of facing elements 64*b* and 64*c*.

Figure 6:
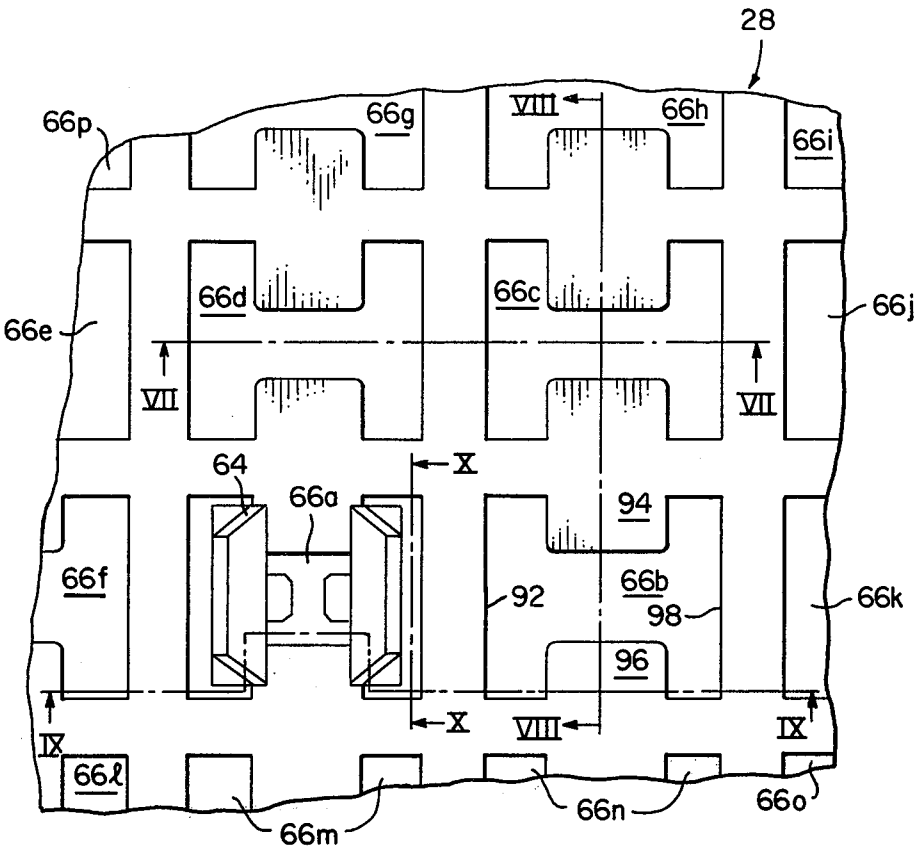
FIG. 6 is a plan elevation of a segment of the cam plate of the connector of FIG. 1 with one contact seated therein for purposes of explanation.

One such contact 64 is shown in conjunction with cam plate 28 in FIG. 6, which is a view enlarged approximately twenty times actual size for the two-inch square, twenty-by-twenty array alluded to above. A contact 64 would, of course, be resident in each of plate apertures 66, but such other contacts are here omitted for convenience and to simplify exposition. The segment of plate 28 shown in FIG. 6 includes apertures 66*a* through 66*p*, each of which has identical outline, as now discussed for aperture 66*b*.

Figure 7:
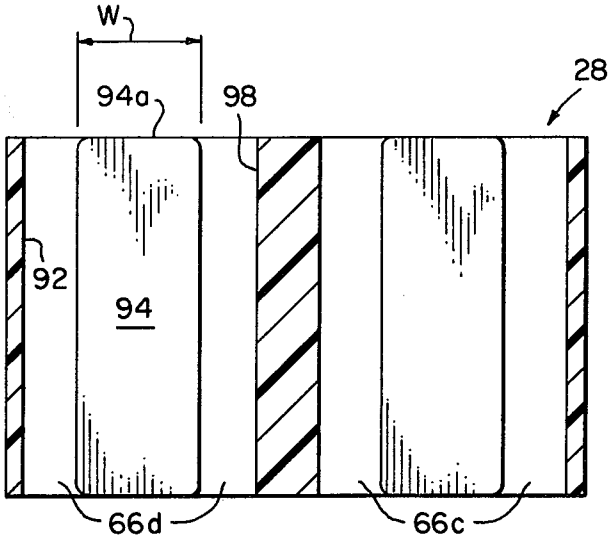
FIG. 7 is a partial sectional view of the cam plate of the connector of FIG. 1 as seen from plane VII—VII of FIG. 6.
Figure 8:
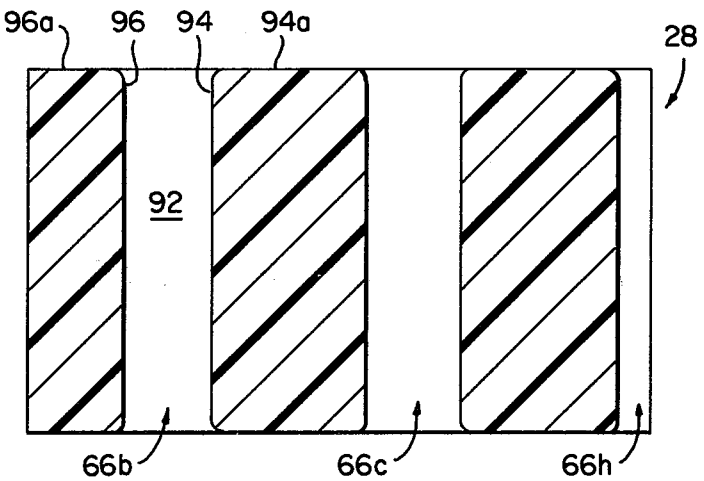
FIG. 8 is a partial sectional view of the cam plate of the connector of FIG. 1 as seen from plane VIII—VIII of FIG. 6.

Considering FIGS. 6–8 jointly with FIGS. 2–5, wall 92 and the left side walls of cam elements 94 and 96 provide a residence channel for contact facing element 64*b*. Similarly, right wall 98 and the right side walls of cam elements 94 and 96 provide a residence channel for contact facing element 64*c*. Contact lances 64*d* and 64*e* are situated in a non-interference path with plate 28, being of expanse less than the spacing across the aperture between opposed cam elements 94 and 96. Conversely, the cam elements extend marginally into the space 64*h* between contact facing elements 64*b* and 64*c*. Accordingly, if plate 28 were to be moved forwardly outwardly of the plane of FIG. 6, contact 64 remaining fixed, cam surfaces 94*a* and 96*a* would engage contact undersurfaces 64*f*-3 and 64*f*-4 and oppose the self-bias of facing elements 64*b* and 64*c* to displace same outwardly of each other.

Figure 10:
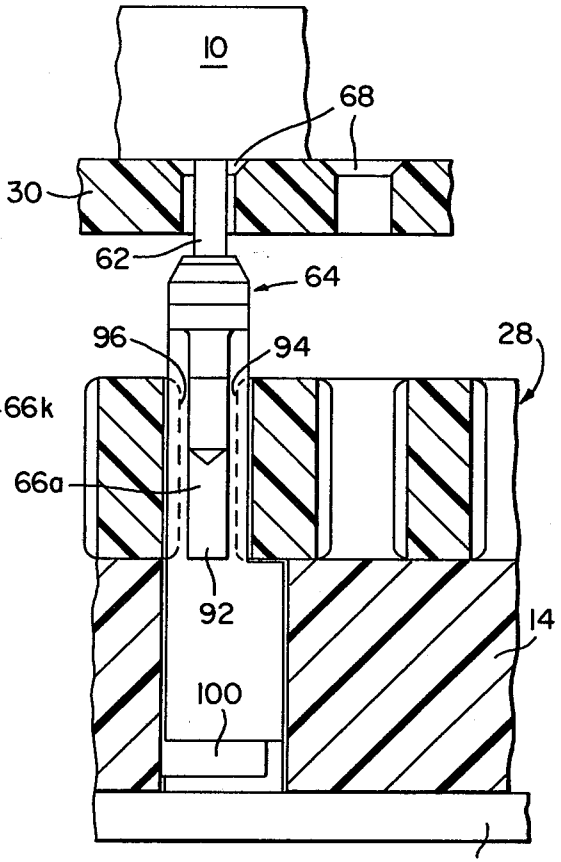
FIG. 10 is a partial sectional view as seen from broken plane X—X of FIG. 6, with the contact, VLSI device, device pin and companion apparatus being shown without sectioning for like convenience and simplification of discussion.
Figure 9:
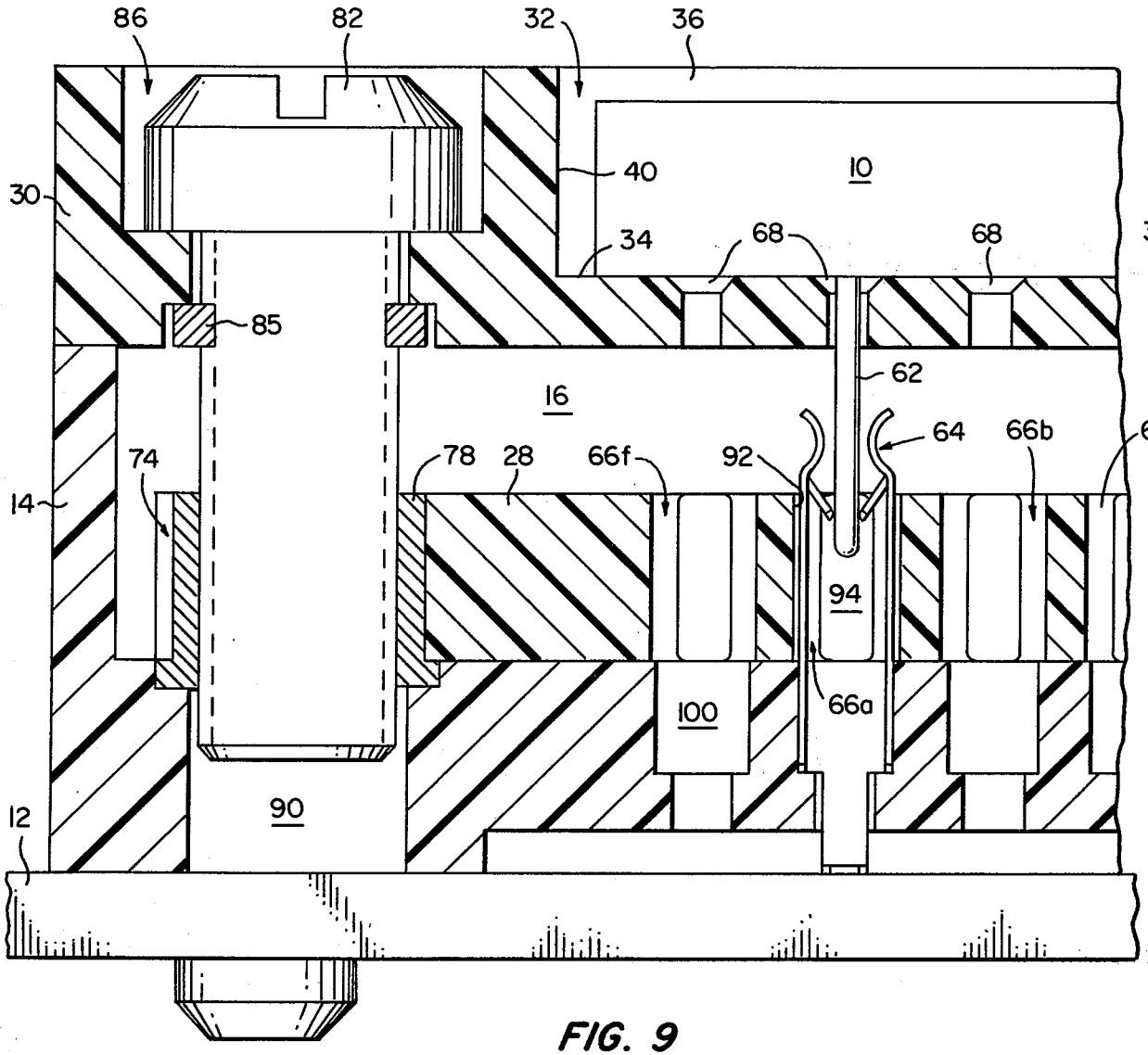
FIG. 9 is a sectional view as seen from broken plane IX—IX of FIG. 6 with the cam actuating pin, contact, VLSI device, device pin and companion apparatus being shown without sectioning for convenience and simplification of discussion.

As cam plate 28 is actually disposed in the plane of FIG. 6, the cam surfaces are inactive, being remote from the cammed contact surfaces 64*f*-3 and 64*f*-4, this condition of the connector being further seen in FIGS. 9 and 10. Here, member 82 is rotated fully counterclockwise in insert 78, placing cam plate 28 in its lowermost position, adjacent base floor 18. In such cam inoperative position, contact facing elements exert the full force of contact self-bias upon pin 62 therebetween.

Figure 11:
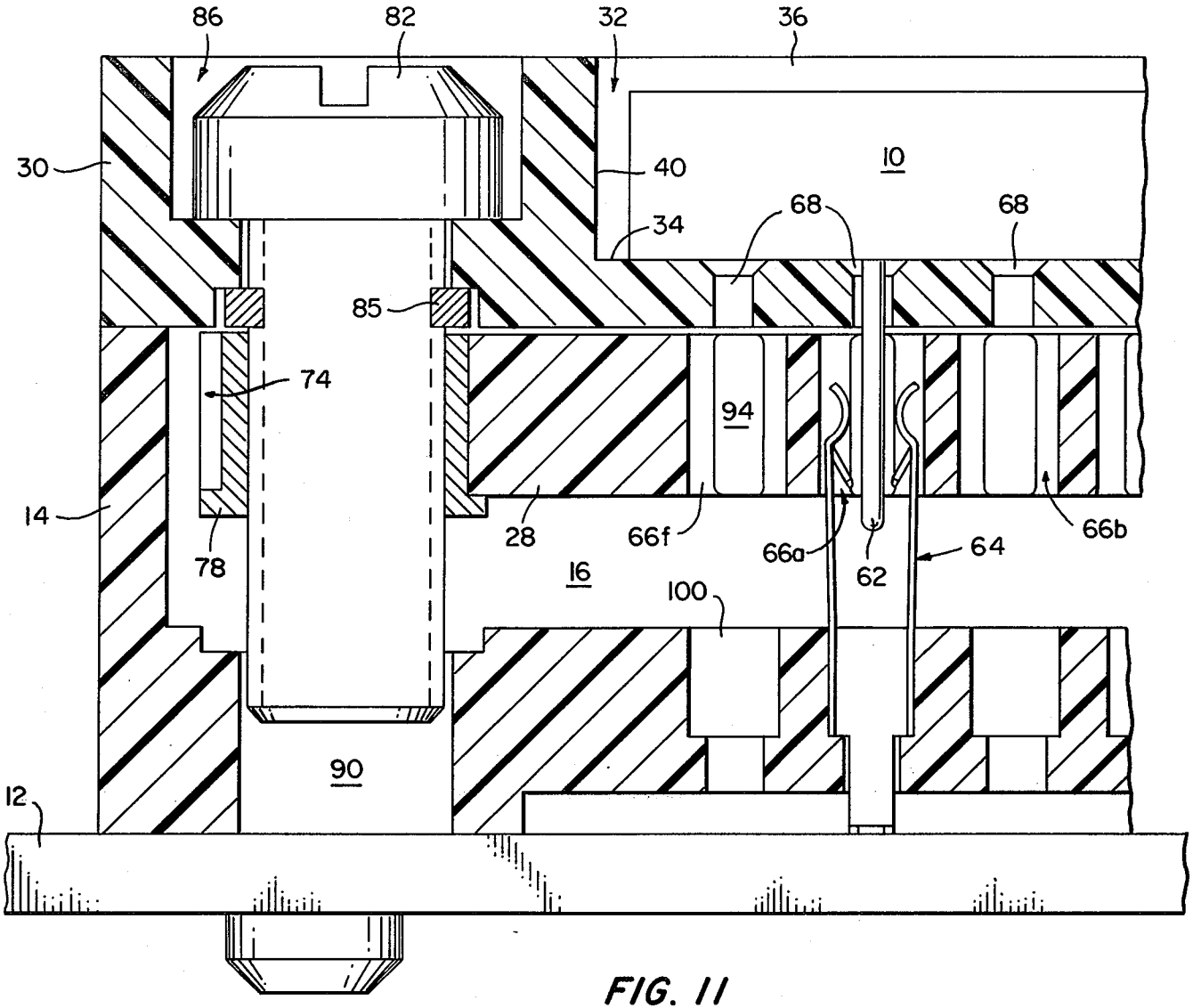
FIG. 11 is a sectional view, as in FIG. 9, but with the cam plate in operative position, i.e., opposing socket element self-bias and displacing the socket elements to facilitate pin entry in the socket.

The converse condition of the connector, i.e., cam operative position, is seen in FIG. 11. Here, member 82 is rotated fully clockwise in insert 78, placing cam plate 28 in its uppermost position, adjacent cover 30. In such cam operative position, contact self-bias is opposed and contact facing elements are displaced outwardly of one another, bending elastically about the locations of their exit from base apertures 100. Pin 62 is readily inserted into contact 64 under this condition and is shown in such seated condition.

The extent of deflection of facing elements 64*b* and 64*c* in the cam operative position may be readily established by selection of the width (W in FIG. 7) of cam elements 94 and 96, once the configuration of contacts 62 is established. Thus, while FIG. 11 shows a zero insertion force condition, the contact lances being non-contiguous with pin 62, advantage attends a low, rather than zero, insertion force. Thus, the invention prefers selection of cam element and contact dimensions to provide, in the cam operative position, for the spacing between opposing lance end surfaces from one another to be less than the diameter of pin 62. The lance end surfaces thus frictionally slidably engage pin 62 upon insertion giving rise to measurable insertion force. The lance end surfaces are preferably arcuate, as noted above. Upon release of the opposing force exerted on the facing contact elements 64*b* and 64*c* by the cam plate 28, the lances 64*d* and 64*e*, under the influence of the self-bias force of the contact, provide a further wiping action as between such arcuate surfaces and the pins. By virtue of the pin wiping action, surface oxides may be removed and gas-tight electrical connection readily realized.

Various modifications to the foregoing disclosed connector will be evident to those skilled in the art and may be introduced without departing from the invention. Thus, the particularly described preferred embodiment is intended in an illustrative and not in a limiting sense. The true spirit and scope of the invention is set forth in the following claims.

What is claimed is:

1. An electrical connector for interconnecting a plurality of terminal pins in predetermined array to companion apparatus, comprising:

(a) a housing;

(b) a plurality of contacts supported by said housing in said array and extending in a common direction, each such contact having a first terminal for connection to said companion apparatus and a second terminal adapted for receiving one such terminal pin and having facing elements self-biased into preselected attitude; and (c) a plate member defining apertures in registry with and for receipt of said second terminals, said plate member being supported for movement in said housing in said common direction between a first position wherein said plate member engages said facing elements of all such second terminals to oppose such self-bias thereof and displace said facing elements from said preselected attitude whereby said pins may be readily received in said second terminals, and a second position wherein said plate member does not oppose said second terminal self-bias whereby said facing elements may exert full force of said self-bias upon pins therebetween.

2. The connector claimed in claim 1 wherein said cam means comprises a plate member defining apertures therethrough in registry with said second terminals, said housing supporting said plate member for movement in said common direction.

3. The connector claimed in claim 2 wherein said cam surface for each such aperture is resident in said second terminal throughout the course of movement of said plate member between such first and second positions.

4. The connector claimed in claim 2 wherein said cam surface for each such aperture comprises a pair of surfaces mutually oppositely disposed across said aperture.

5. The connector claimed in claim 1 wherein said housing comprises a base supporting said contacts and a cover secured to said base and defining passages therethrough for access to said second terminals.

6. The connector claimed in claim 5 wherein said base supports said first terminals exteriorly thereof.

7. The connector claimed in claim 1 further including position control means accessible exteriorly of said housing and connected to said plate member for selective positioning thereof.

8. The connector claimed in claim 5 further including position control means extending through said cover and accessible exteriorly thereof and connected to said plate member for selective positioning thereof.

9. The connector claimed in claim 8 wherein said plate member supports an interiorly threaded bore therethrough, said position control means comprising an exteriorly threaded member extending through said cover and resident in said bore, rotation of such threaded member giving rise to movement of said plate member.

10. The connector claimed in claim 1 wherein said facing elements are mutually spaced, with said plate members in said first position thereof, sufficiently to define an entry path for said pins into said housing which is free from contact interference.

11. The connector claimed in claim 1 wherein said facing elements are mutually spaced, with said plate members in said first position thereof, so as to provide for sliding engagement of said contacts with said pins in the course of entry of said pins in said housing.

12. An electrical connector for interconnecting a plurality of terminal pins in predetermined array to companion apparatus, comprising:

(a) a housing;

(b) a plurality of contacts supported by said housing in said array and extending in a common direction, each such contact having a first terminal for connection to said companion apparatus and a second terminal adapted for receiving one such terminal pin and having facing elements self-biased into preselected attitude; and (c) cam means supported for movement in said housing in said common direction, said cam means defining a plurality of openings, each receiving one of said contacts therein and for receiving one of said terminal pins therein, said cam means including a cam surface within each of said openings, said cam means being movable between a first position wherein said cam surfaces engage said facing elements of all such second terminals to oppose such self-bias thereof and displace said facing elements from said preselected attitude whereby said pins may be readily received in said second terminals, and a second position wherein said cam surfaces do not oppose said second terminal self-bias whereby said facing elements may exert full force of said self-bias upon pins therebetween.

13. The electrical connector of claim 12, wherein said cam means defines surfaces of each of said openings fully bounding each of said contacts.

14. The electrical connector of claim 12, wherein all such cam surfaces are collectively movable.

* * * * *